United States Patent [19]

Terauchi

[11] Patent Number: 5,051,067

[45] Date of Patent: Sep. 24, 1991

[54] RECIPROCATING PISTON COMPRESSOR WITH VARIABLE CAPACITY MACHANISM

[75] Inventor: Kiyoshi Terauchi, Gunma, Japan

[73] Assignee: Sanden Corporation, Japan

[21] Appl. No.: 433,417

[22] Filed: Nov. 7, 1989

Related U.S. Application Data

[63] Continuation of Ser. No. 171,170, Mar. 21, 1988, abandoned, which is a continuation of Ser. No. 918,068, Oct. 14, 1986, abandoned.

[30] Foreign Application Priority Data

Oct. 11, 1985 [JP] Japan ..... 60-226395

[51] Int. Cl.[5] ..... F04B 1/26; F01B 3/00; F01B 13/04

[52] U.S. Cl. ..... 417/222 R; 417/222 S; 417/269; 417/270; 92/12.2

[58] Field of Search ..... 92/12.2, 71; 417/222, 417/222 S, 269, 270

[56] References Cited

U.S. PATENT DOCUMENTS

| | | | |
|---|---|---|---|
| 723,709 | 1/1932 | Bedwneau | 92/12.2 |
| 2,299,235 | 6/1937 | Snader | 91/506 |
| 2,400,119 | 5/1946 | Joy | 417/269 |
| 2,682,226 | 6/1954 | Brennan | 417/269 |
| 3,062,020 | 11/1960 | Heidorn | 417/269 |
| 3,861,829 | 1/1975 | Roberts et al. | 417/222 |
| 4,037,993 | 7/1977 | Roberts | 417/222 S |
| 4,073,603 | 2/1978 | Abendschein et al. | 417/222 |
| 4,076,603 | 2/1978 | Andersen | 204/98 |
| 4,132,086 | 1/1979 | Kountz | 62/209 |
| 4,145,163 | 3/1979 | Fogelberg et al. | 417/222 |
| 4,174,191 | 11/1979 | Roberts | 417/269 |
| 4,231,713 | 11/1980 | Widdowson et al. | 417/269 |
| 4,294,139 | 10/1981 | Bex et al. | 91/506 |
| 4,428,718 | 1/1984 | Skinner | 417/222 |
| 4,433,596 | 2/1984 | Scalzo | 92/12.2 |
| 4,480,964 | 11/1984 | Skinner | 417/222 S |
| 4,506,648 | 3/1985 | Roberts | 92/12.2 |
| 4,526,516 | 7/1985 | Swain et al. | 417/222 S |
| 4,533,299 | 8/1985 | Swain et al. | 417/222 |
| 4,586,874 | 5/1986 | Hiraga et al. | 417/222 S |
| 4,632,640 | 12/1986 | Teracuhi . | |
| 4,664,604 | 5/1987 | Terauchi . | |
| 4,687,419 | 8/1987 | Suzuki et al. | 417/222 |
| 4,688,997 | 8/1987 | Suzuki et al. | 417/222 |
| 4,729,718 | 3/1988 | Ohta et al. | 417/222 |
| 4,870,894 | 10/1989 | Toyoda et al. | 92/71 |

FOREIGN PATENT DOCUMENTS

| | | | |
|---|---|---|---|
| 3545581A1 | 7/1986 | Fed. Rep. of Germany . | |
| 0162087 | 8/1985 | Japan | 417/222 S |
| 2153922 | 8/1985 | United Kingdom | 417/222 |

*Primary Examiner*—Edward K. Look
*Assistant Examiner*—Thomas Denion
*Attorney, Agent, or Firm*—Banner, Birch, McKie & Beckett

[57] ABSTRACT

A wobble plate type compressor with a variable capacity mechanism is disclosed. Changing the displacement of a cylinders and therefore the capacity of the compressor is accomplished by varying the angle of an inclined surface of the wobble plate. This angle is varied by changing the difference in pressure between the crank chamber and the suction chamber. This pressure difference is controlled by changing the suction chamber pressure while uniformly maintaining the crank chamber pressure. In one embodiment the capacity varying mechanism includes a bellows. In another embodiment the capacity varying mechanism includes an electromagnetic valve and an electronic pressure sensor.

20 Claims, 5 Drawing Sheets

RECIPROCATING PISTON COMPRESSOR WITH VARIABLE CAPACITY MACHANISM

This application is a continuation of Ser. No. 07/171,170, filed Mar. 21, 1988, which is a continuation of Ser. No. 06/918,068, filed Oct. 14, 1986, both now abandoned.

TECHNICAL FIELD

The present invention relates to a reciprocating piston compressor, in particular a wobble plate type compressor for a refrigeration system such as that found in automobiles. More particularly, the present invention relates to a variable capacity mechanism for use on a wobble plate type compressor.

BACKGROUND OF THE INVENTION

A wobble plate type compressor which reciprocates pistons by converting the rotational movement of a cam rotor into nutational movement of a wobble plate is well known in the art. A variable capacity mechanism which changes compression capacity is also well known, as shown in U.S. Pat. No. 3,861,829. In this mechanism, piston displacement is altered by varying the angle of the inclined surface of the cam rotor by a pressure difference between the crank chamber in which the cam rotor is disposed and the suction chamber. Thus, the compression capacity of the compressor varies with the piston displacement.

One of the disadvantages of the above mechanism is that the lower valve does not determine the suction pressure at which the variable capacity mechanism begins operating. Because the suction pressure of the refrigerant corresponds to the evaporating temperature of the refrigerant, if the lower valve determines the suction pressure, the surface of the evaporator may freeze. Thus, the pull-down characteristics of the compressor are not sufficient. Also, because the pressure in the crank chamber is controlled and the volume of the crank chamber is larger than that of the suction chamber, the piston response to changing the angle of the inclined surface of the cam rotor is not adequate. Furthermore, when the pressure difference between the crank chamber and the suction chamber changes, oil may flow into the crank chamber from the suction chamber.

SUMMARY OF THE INVENTION

It is an object of this invention or provide a wobble plate type compressor with a variable capacity mechanism which is suitable for use in any type of refrigeration circuit.

It is another object of this invention to provide a wobble plate type compressor with a variable capacity mechanism which prevents oil leakage and has improved durability.

A wobble plate type compressor with a variable capacity mechanism according to this invention includes a compressor housing having a crank chamber, a suction chamber, and a cylinder block in which a plurality of cylinders are formed, and rear and front end plates. A passageway formed in the cylinder block connects the crank chamber to the suction chamber. A piston is reciprocatingly disposed within each respective cylinder. A drive shaft is rotatably supported in the housing and a rotor having an inclined surface is fixed on the drive shaft. A variable angle rotating cylindrical member is disposed on the drive shaft adjacent the rotor. A wobble plate, disposed proximate the cylindrical member, is coupled to the pistons. The angle of the cylindrical member and the wobble plate is varied by a variable capacity mechanism. The variable capacity mechanism comprises a valve, disposed within the passageway, which opens and closes the passageway using the pressure difference between the crank chamber and the predetermined chamber. A control device controls the operation of the valve and maintains the crank chamber pressure at a uniform predetermined level, while the suction chamber pressure is varied. The control device includes a pressure detecting element for detecting pressure in the crank chamber and a comparing device for comparing the detected pressure with the predetermined pressure.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

dr

DETAILED DESCRIPTION OF PREFERRED EMBODIMENTS

Figure 1:
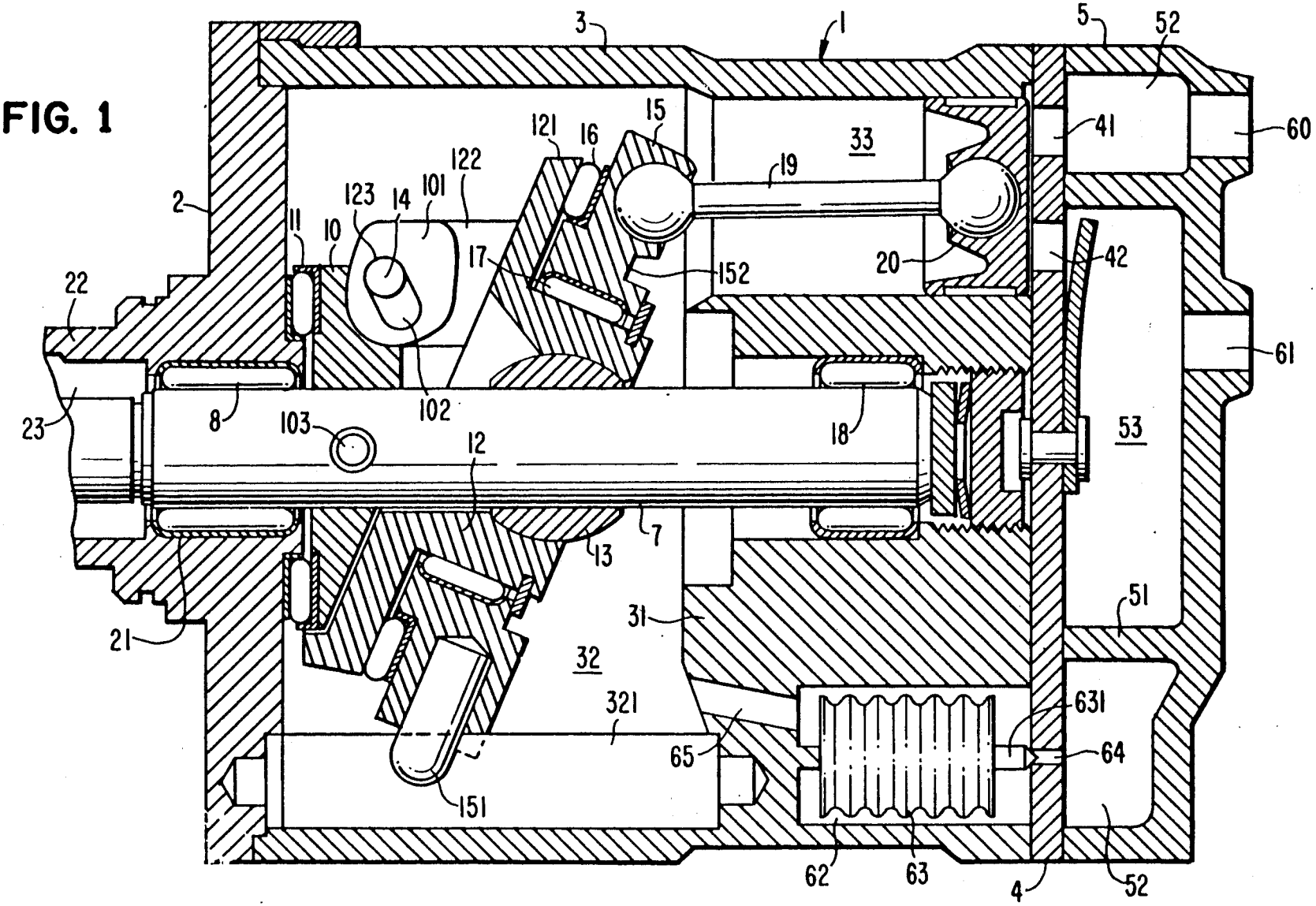
FIG. 1 is a vertical sectional view of a wobble plate type compressor in accordance with one embodiment of this invention.

Referring to FIG. 1, wobble plate type compressor 1 includes front end plate 2, cylinder casing 3 having cylinder block 31, valve plate 4, and cylinder head 5. Front end plate 2 is fixed on one end of cylinder casing 3 by securing bolts (not shown). Axial hole 21 which is formed through the center of front end plate 2 receives drive shaft 7. Radial bearing 8 is disposed in axial hole 21 to rotatably support drive shaft 7. Annular sleeve portion 22 projects from front end plate 2 and surrounds drive shaft 7, defining seal cavity 23. Cylinder casing 3 is provided with cylinder block 31 and crank chamber 32. Cylinder block 31 has a plurality of equiangularly spaced cylinders 33 formed therein.

Cam rotor 10 is fixed on drive shaft 7 by pin 103. Thrust needle bearing 11 is disposed between the inner surface of front end plate 2 and the adjacent axial end surface of cam rotor 10. Arm portion 101 of cam rotor 10 extends in the direction of cylinder block 31. Elongated hole 102 is formed on arm portion 101. Cylindrical member 12, provided with flange portion 121, is disposed around drive shaft 7 and is rotatably supported on drive shaft 7 through spherical element 13 slidably fitted on drive shaft 7. Second arm portion 122 is formed on the outer surface of flange portion 121 of cylindrical member 12 and faces arm portion 101 of cam rotor 10. Hole 123, formed in arm portion 122, is aligned with elongated hole 102. Pin 14, inserted through hole 123, is slidably movable within elongated hole 102. Ring-shaped wobble plate 15 is mounted on the outer surface of cylindrical member 12 through radial needle bearing 16. Thrust needle bearing 17 is disposed in a gap between flange portion 121 and wobble plate 15. The other end of drive shaft 7 is rotatably supported through radial bearing 18 in the central bore of cylinder block 31. Sliding shaft 151 is attached on the outer peripheral portion of wobble plate 15 and projects toward the bottom surface of cylinder casing 3. The end of sliding shaft 151 is slidably disposed in groove 321 to prevent the rotation of wobble plate 15.

One end of piston rod 19 is rotatably connected to receiving surface 152 of wobble plate 15. The other end of piston rod 19 is rotatably connected to piston 20 which is slidably disposed in cylinder 33.

Suction port 41 and discharge port 42 are formed in valve plate 4. Suction reed valve (not shown) is disposed on valve plate 4. Discharge reed valve (not shown) is disposed on valve plate 4 opposite the suction reed valve. Cylinder head 5 is connected to cylinder casing 3 through a gasket (not shown) and valve plate 4. Partition wall 51 extends axially from the inner surface of cylinder head 5 and divides the interior of cylinder head 5 into suction chamber 52 and discharge chamber 53. Suction chamber 52 is connected to the external fluid circuit through fluid inlet port 60 formed in cylinder head 5. Discharge chamber 53 is connected to the external fluid circuit through fluid outlet port 61 formed in cylinder head 5.

Bellows 63 is disposed in cylindrical bore 62 formed in cylinder block 31. Bore 62 communicates with suction chamber 52 through aperture 64 formed in valve plate 4 and communicates with crank chamber 32 through passageway 65 formed in cylinder block 31. Aperture 64 is normally closed by needle element 631 disposed on one end of bellows 63. Bore 62 is connected to crank chamber 32 through connecting way 65.

In operation, rotational motion is applied to drive shaft 7 through an external driving source (not shown) and is communicated to cam rotor 10. The rotational motion of cam rotor 10 is converted to nutational motion at wobble plate 15 through cylindrical member 12. Sliding shaft 151, connected to wobble plate 15 and disposed in groove 321, prevents wobble plate 15 from rotating. The nutational motion of wobble plate 15 is converted to the reciprocating motion of pistons 20 in cylinders 33 through piston rods 19. Accordingly, refrigeration fluid is sucked through inlet port 60 through suction chamber 52 and flows into cylinder 33 through suction port 41. Refrigeration fluid is compressed in cylinder 33 and discharged into discharge chamber 53 through discharge port 42. The compressed refrigeration fluid then flows into the external fluid circuit through outlet port 61.

Figure 2:
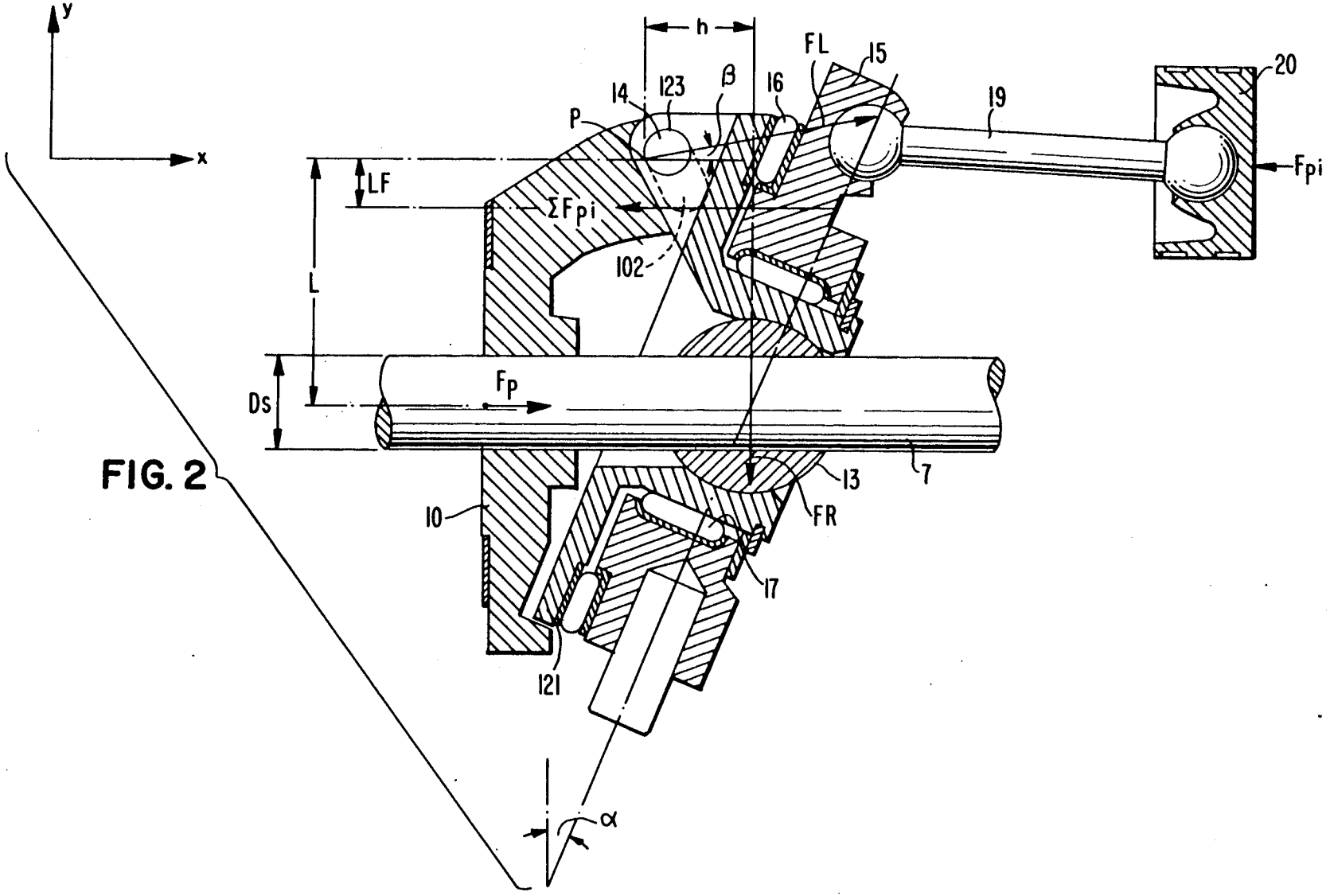
FIG. 2 is a diagramatic view of the angle-varying mechanism of the wobble plate type compressor of FIG. 1

Referring to FIG. 2, the mechanics of the nutational movement of the compressor will be explained. During the compression stroke, the gas pressure in each cylinder 33 in front of piston 20 is Fpi, and the gas pressure in all cylinders 33 is ΣFpi. For clarity, only one piston is shown, although any number may be used. The gas pressure ΣFpi urges piston 20 and piston rod 19 to the left. The drag at contact point P between pin 14 and elongated hole 102 is FL. The coefficient of friction between drive shaft 7 and spherical element 13 is expressed as $\mu$. FR is the force of spherical element 13 on drive shaft 7. $-\mu$FR is the frictional force when the compressor operates at a reduced capacity, and $+\mu$FR is the frictional force when the compressor operates at an increased capacity. The gross gas pressure ΣFpi can be determined from the following equation:

$$\Sigma Fpi = FL\cos\beta \pm \mu FR + Fp \quad (1)$$

where $\beta$ is the angle formed by the drag FL with the X-axis, and Fp is the force on the rear surface of the piston. Fp is calculated from the following equation:

$$Fp = n(S)Pc \quad (2)$$

where n is the number of pistons, S is the area of the piston, and Pc is the pressure in the crank chamber.

Fr is the force component of the drag FL orthogonal to drive shaft 7 and is determined from the following equation:

$$FR = FL\sin\beta \quad (3)$$

Also, if the distance between the acting point P of the force on the supporting portion of pin 13 and ΣFpi is LF, the X-axis (axis parallel to shaft 7 axis) distance between the acting point P and force FR is h, the distance between the acting point P and the central axis of drive shaft 7 is L, and the diameter of drive shaft 7 is Ds, the equation for the conservation of momentum around point P can be derived from equation (1) and is as follows:

$$(\Sigma Fpi)LF + (Fr)h = \pm\mu FR(L + Ds/2) + (Fp)L \quad (4)$$

Cylindrical member 12 and wobble plate 15 incline at an angle $\alpha$ to conserve momentum. As shown from equation 4, changing force Fp changes the inclined angle of wobble plate 15. Force Fp is changed by changing the pressure in the crank chamber while maintaining a constant pressure in the suction chamber. However, if the change of pressure in the crank chamber is used as the origin for varying the incline angle of the wobble plate, several disadvantages may occur, as mentioned above.

Figure 3:
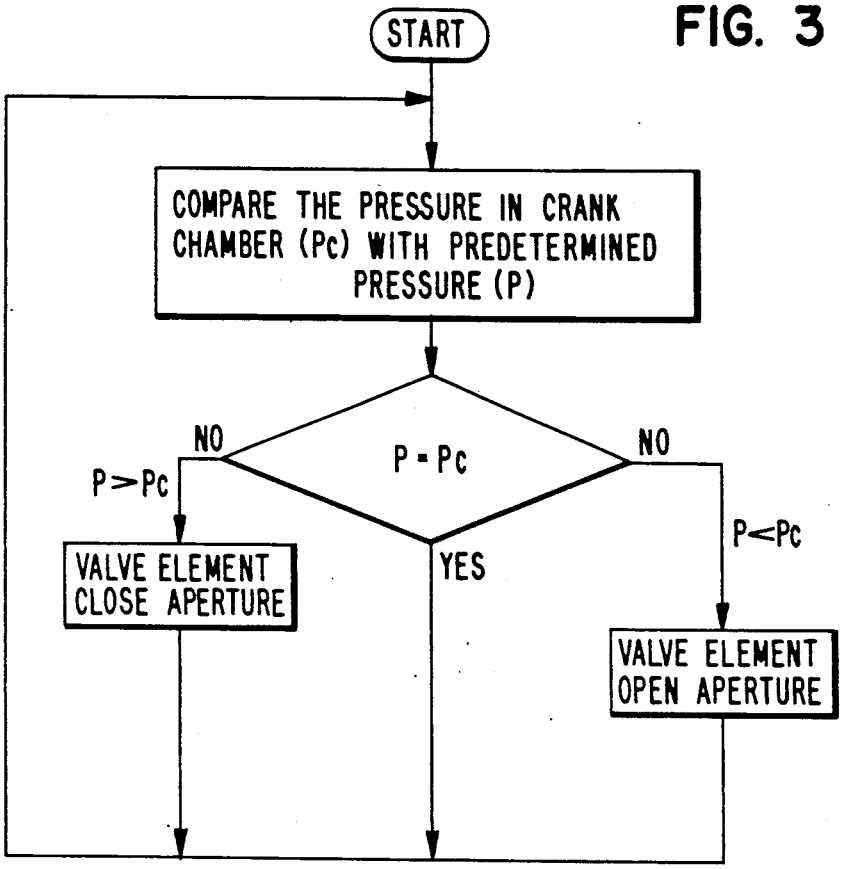
FIG. 3 is a block diagram of the control device for the angle-varying mechanism.

Referring to FIGS. 3 and 4, the control method of the variable capacity mechanism of the present invention will be explained. Cylindrical bore 62, in which bellows 63 is disposed, is connected to crank chamber 32 through passageway 65. Therefore, if the crank chamber pressure Pc exceeds the pressure in bellows 63 due to blow-by gas, bellows 63 contracts and opens aperture 64. The gas in crank chamber 32 flows into suction chamber 52 through aperture 64. On the other hand, if the crank chamber pressure Pc is less than the pressure in bellows 63, bellows 63 expands, forcing needle element 631 to close aperture 64. This increases the pressure in crank chamber 32 due to blow-by gas.

As discussed above, the pressure in crank chamber 32 can be uniformly maintained within a sufficiently narrow range at a predetermined level (in FIG. 3, the pressure P indicates the central point of the predetermined level). Therefore the inclined angle of cylindrical member 12 and wobble plate 15 is varied by the pressure difference between crank chamber 32 and suction chamber 52, which changes primarily due to the change in suction pressure. This suction pressure change causes a change in ΣFpi which changes the momentum around point P, thereby varying the angle of the wobble plate and the capacity of the compressor.

Figure 4A:
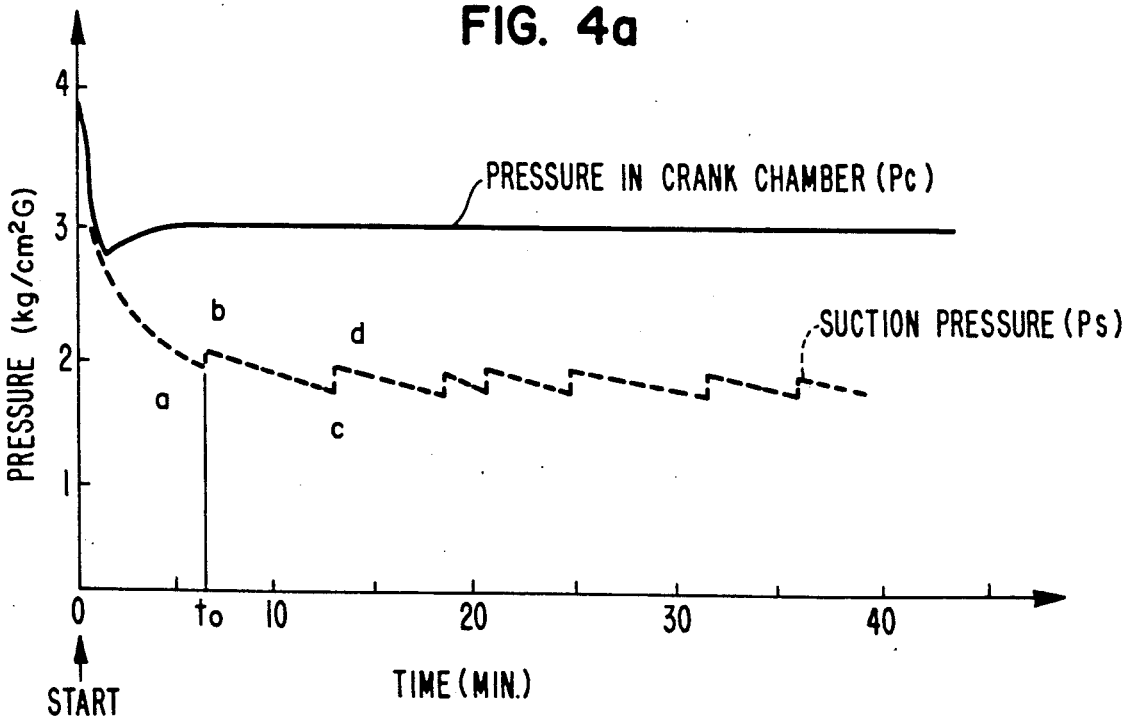
FIG. 4*a* and 4*b* are graphs illustrating the changes in suction chamber pressure and crank chamber pressure as a function of operating time.

In operation, crank chamber pressure Pc initially drops, but quickly stabilizes at a predetermined level as shown in FIG. 4*a*. However, suction pressure Ps is continuously reduced along with the reduction of heat load. (The heat load corresponds to the temperature in passenger compartment).

After the passage of a predetermined length of time $t_0$, the suction pressure Ps reaches point "a" shown in FIG. 4*a*, and the capacity control mechanism begins operating to maintain a constant pressure Pc as illustrated graphically in FIG. 3 and to conserve momentum as shown in equation 4. That is, the inclined angle of cylindrical member 12 and wobble plate 15 is changed to reduce the capacity of the compressor. When the suction pressure Ps increases and reaches point "b" shown in FIG. 4*a*, reduction of the inclined angle of cylindrical member 12 and wobble plate 15 ceases. Thus, the compressor continues operation at a uniform, reduced capacity. Even with reduction of the compressor's capacity, reduction of the heat load results and the suction pressure is reduced. The above method reduces compressor capacity while maintaining a constant heat load. Because the friction force changes with the change in the inclined angle, suction pressure Ps undergoes step changes as shown in FIG. 4*a*.

Figure 4B:
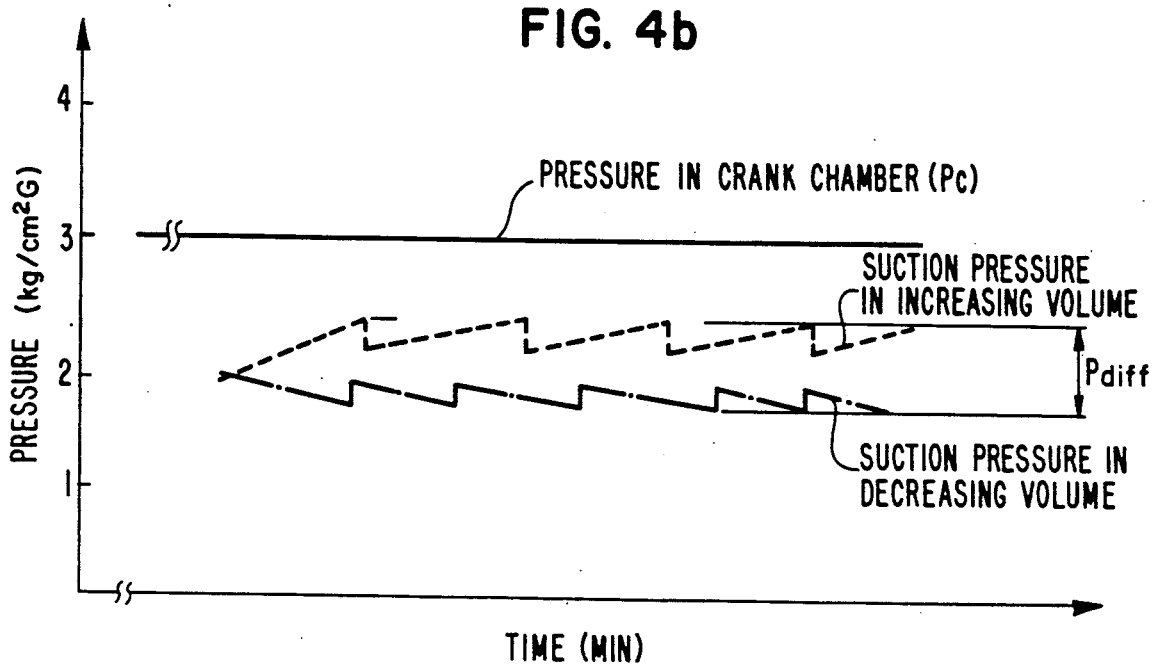

Through the operation of the capacity control mechanism, the change in suction pressure caused by changing the heat load is maintained within a predetermined range as shown in FIG. 4*b*. As shown in the figure, when the heat load is reduced, suction pressure Ps changes according to the lower dot-dash line, and when the heat load is increased the suction pressure changes according to the upper dashed line. The suction pressure at which the variable capacity mechanism begins operating to reduce the capacity on the one hand and to increase the capacity on the other hand are different.

Figure 4C:
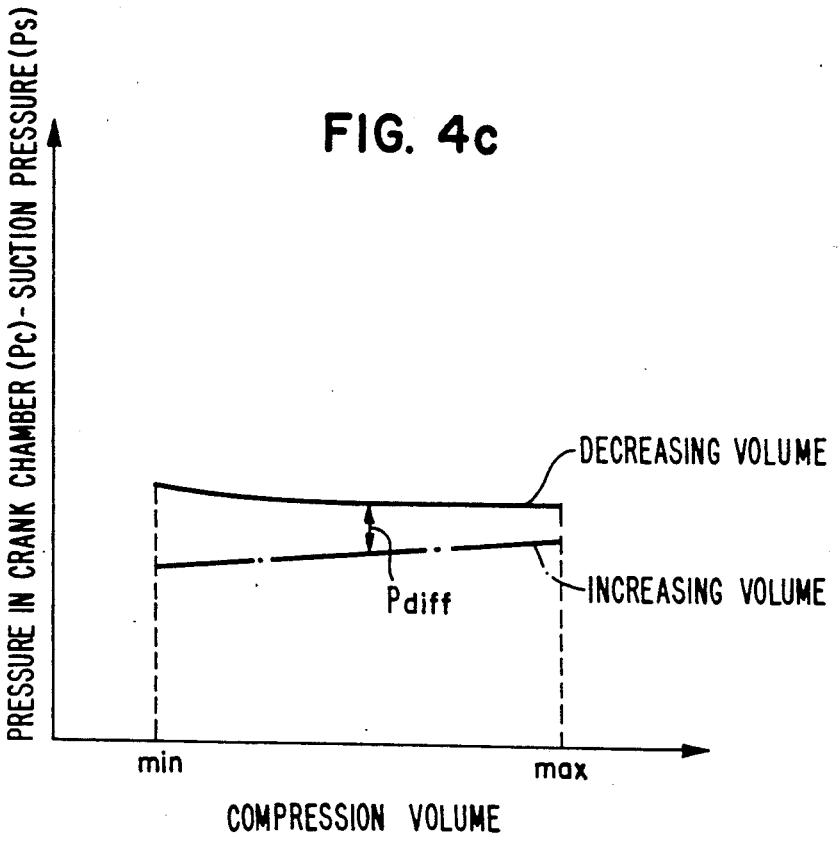
FIG. 4*c* is graph illustrating the change in compression volume as a function of the pressure difference between the crank chamber and the suction chamber.

The pressure difference between the crank chamber and the suction chamber to operate the capacity control mechanism is different for reducing capacity than for increasing capacity, as shown in FIG. 4*c*. This pressure difference has a hysteresis caused by the frictional force. The hysteresis and is determined by the angle $\beta$ between cam rotor 10 and cylindrical member 12, and the coefficient of friction $\mu$. The difference between the pressure differences generates a temperature differential in the passenger compartment. However, this temperature change may be controlled within practical limits by appropriately selecting angle $\beta$, coefficient of friction $\mu$, and the position of cylindrical member 12.

Figure 5:
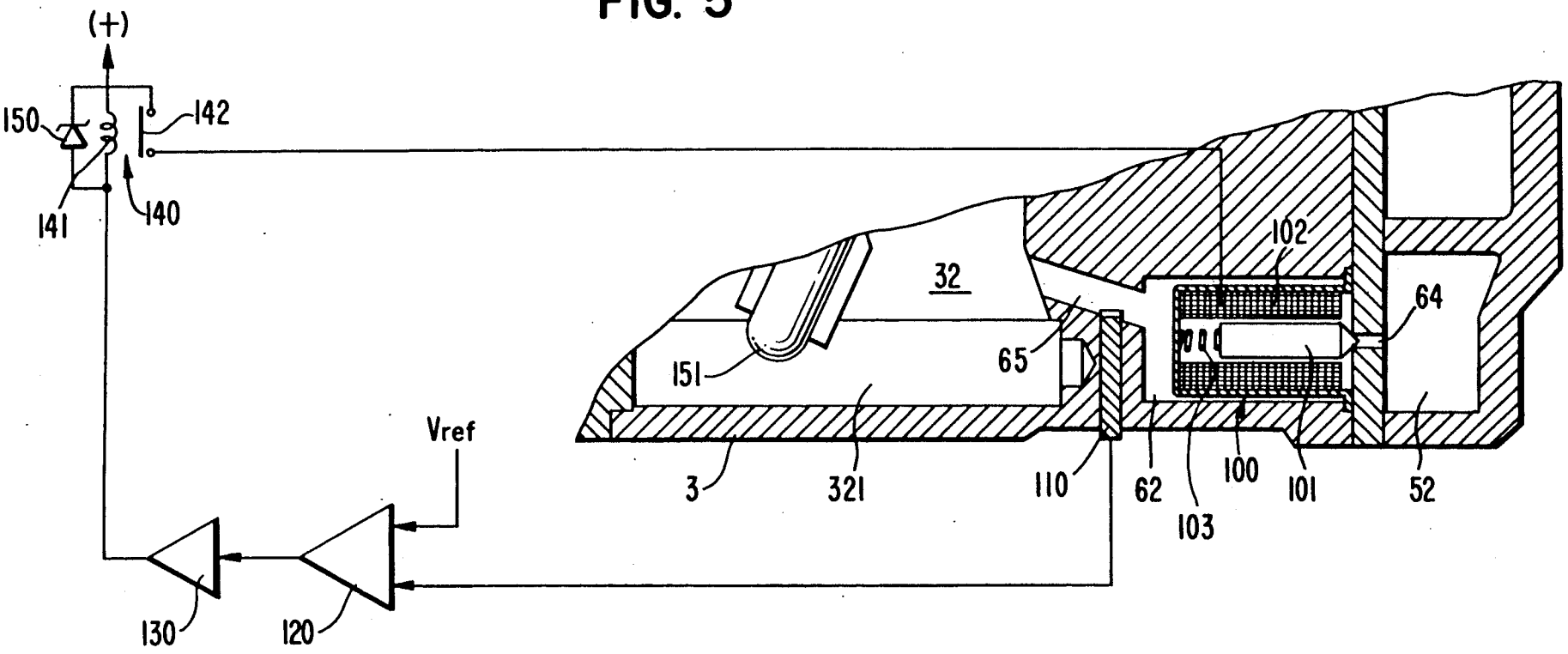
FIG. 5 is a partial sectional view of a wobble plate type compressor illustrating the main portion of a variable capacity mechanism according to another embodiment of this invention.

Referring to FIG. 5, another embodiment of the wobble plate type compressor with a variable capacity mechanism is shown. Electronic valve means 100 is disposed within cylindrical bore 62 and valve element 101 controls the opening and closing of aperture 64. Valve element 101 is normally biased to close aperture 64 by spring 103. Pressure detecting means such as pressure sensor 110 is disposed in cylindrical casing 3 to detect the pressure in passageway 65 and crank chamber 32.

The detecting signal generated by pressure sensor 110 is input to a conventional control circuit. One such circuit is illustrated in FIG. 5 wherein the signal from pressure detecting means is input to comparator 120 which is connected with coil 141 of relay 140 and zener diode 150 through relay controller 130. Relay 140 has a normally closed terminal 142, one end of which is connected to coil 102 of electromagnetic valve means 100. Therefore movement of valve element 101, which opens and closes aperture 64, is controlled by relay 140.

In operation, the pressure in crank chamber 32 is uniformly maintained as follows. When the pressure exceeds the predetermined level, the detecting signal of pressure sensor 110 is compared with a reference voltage level, Vref, in comparator 120 which outputs a high level signal such as a positive voltage. Vref is selected to correspond to the desired predetermined pressure for crank chamber 32. This positive voltage from comparator 120 is amplified by relay controller 130, the circuit is closed, and current is supplied to coil 102 of electromagnetic valve means 100 through zener diode 150. Energization of coil 102 causes valve element 101 to open aperture 64, permitting refrigeration fluid to flow from crank chamber 32 to suction chamber 52 through passageway 65, bore 62 and aperture 64.

If the pressure in crank chamber 32 fails below the predetermined level, a low voltage signal such as zero or negative voltage is output from comparator 120. The current from a power source is applied to coil 141 of relay 140 and opens terminal 142. Coil 102 is not energized and valve element 101 is urged toward valve plate 4 to close aperture 64. Therefore, the pressure in crank chamber 32 is increased by the blow-by gas.

As discussed above, the variable displacement mechanism of this invention is controlled by changing the suction pressure while maintaining the crank chamber pressure at a predetermined level. The suction pressure, and hence the evaporating temperature of the refrigerant, at which the variable displacement mechanism begins operation can be set at a lower level without causing freezing on the evaporator. This improves cool-down characteristics of the compressor. Also, because the crank chamber pressure is uniformly maintained, oil contained therein is prevented from flowing out.

Numerous characteristics, advantages, and embodiments of the invention have been described in detail in the foregoing description with reference to the accompanying drawings. However, the disclosure is illustrative only and it is to be understood that the invention is not limited to the precise illustrated embodiments. Various changes and modifications may be affected therein by one skilled in the art without departing from the scope or the spirit of the invention.

I claim:

1. A reciprocating piston compressor capable of operating at variable capacity, said compressor comprising:

a compressor housing having a crank chamber and a suction chamber connected by a passageway;

a cylinder block disposed in said compressor housing having a plurality of cylinders disposed therein;

a plurality of pistons, each of said pistons being reciprocatingly disposed in a respective one of said cylinders;

a rotatable drive shaft rotatably supported in said compressor housing;

a rotor fixed on said drive shaft;

a member hingedly connected to said rotor and whose angle may be varied relative to said drive shaft to vary the capacity of the compressor;

coupling means for coupling said member to said pistons to transform the rotational motion of said rotor to reciprocating motion of said pistons; and capacity varying means for varying the capacity of the compressor by maintaining the crank chamber pressure at substantially a predetermined level and utilizing changes in the suction chamber pressure to vary the angle of said member, said capacity varying means comprising valve means disposed within said cylinder block and within said passageway for opening and closing said passageway, and control means for controlling the operation of said valve means to maintain the crank chamber pressure at substantially the predetermined level;

wherein said control means comprises pressure detecting means for detecting the pressure in said crank chamber and comparing means for comparing the detected pressure with a predetermined pressure to open said passageway when the crank chamber pressure exceeds the predetermined pressure and to close said passageway when the predetermined pressure exceeds the crank chamber pressure.

2. A compressor as set forth in claim 1 wherein said passageway comprises a cylindrical bore formed in said cylinder block, a first connecting passageway in fluid communication between said crank chamber and said bore, and a second connecting passageway in fluid communication between said bore and said suction chamber, wherein said valve means is disposed in said cylindrical bore.

3. A compressor as set forth in claim 1 wherein said pressure detecting means and said comparing means comprise a bellows connected at one end to said valve means.

4. A compressor as set forth in claim 2 wherein said valve means comprises an electromagnetic valve, and said pressure detecting means comprises a pressure sensor disposed in said first connecting passageway.

5. A compressor as set forth in claim 4 wherein said comparing means comprises a comparator which electronically compares the signal from said pressure sensor with a reference signal corresponding to the predetermined pressure.

6. A compressor as set forth in claim 4 wherein said electromagnetic valve comprises an electromagnetic coil and a valve element, and said capacity varying means further comprises a spring which biases said valve element to close said second connecting passageway.

7. A compressor as set forth in claim 6 wherein said control means comprises a control circuit comprising a comparator which compares the signal from said pressure sensor with a reference voltage, a relay controller which amplifies the signal from said comparator, and a relay which controls said electromagnetic valve in response to the amplified signal from said relay controller.

8. A reciprocating piston compressor capable of operating at variable capacity, said compressor comprising:

a compressor housing having a crank chamber, a suction chamber and a passageway connecting said crank and suction chambers;

a cylinder block disposed in said compressor housing;

a plurality of cylinders disposed in said cylinder block;

a plurality of pistons, each reciprocatingly disposed in a respective one of said cylinders;

a rotatable drive shaft rotatably supported in said compressor housing;

a rotor fixed on said drive shaft;

a member hingedly connected to said rotor and whose angle relative to said drive shaft can be varied to vary the capacity of the compressor;

coupling means for coupling said member to said pistons to transform the rotational motion of said rotor to reciprocating motion of said pistons; and valve means for opening said passageway when pressure in said crank chamber exceeds a predetermined amount to thereby allow the excess pressure therein to vent through said passageway to said suction chamber and closing said passageway when pressure in said crank chamber falls a predetermined amount to allow the pressure to build up in said crank chamber due to blow-by gas, said valve means thereby maintaining the pressure of said crank chamber at substantially a predetermined set level while the pressure of said suction chamber is varied;

wherein said passageway comprises a bore in said cylinder block, a first connecting passageway providing fluid communication between said crank chamber and said bore, and a second connecting passageway providing fluid communication between said bore and said suction chamber, and said valve means is disposed in said bore.

9. A compressor as set forth in claim 8 wherein said valve means comprises an electromagnetic valve.

10. A compressor as set forth in claim 9 wherein said electromagnetic valve comprises an electromagnetic coil and a valve element.

11. A compressor as set forth in claim 8 wherein said bore comprises a cylindrical bore formed in said cylindrical block.

12. A reciprocating piston compressor capable of operating at variable capacity, said compressor comprising:

a compressor housing having a crank chamber, a suction chamber and a passageway connecting said crank and suction chambers;

a cylinder block disposed to said compressor housing;

a plurality of cylinders disposed in said cylinder block;

a plurality of pistons, each reciprocatingly disposed in a respective one of said cylinders;

a rotatable drive shaft rotatably supported in said compressor housing;

a rotor fixed on said drive shaft;

a member hingedly connected to said rotor and whose angle relative to said drive shaft can be varied to vary the capacity of said compressor;

coupling means for coupling said member to said pistons to transform the rotational motion of said rotor to reciprocating motion of said pistons; and varying means for varying the angle of said member based primarily on changes in said suction chamber while maintaining the pressure in said crank chamber at substantially a predetermined set level;

wherein said varying means comprises valve means for opening and closing said passageway and controlling means for controlling the operation of said valve means; and wherein said passageway is formed in said cylinder block and said valve means is disposed in said cylinder block.

13. A reciprocating piston compressor capable of operating at variable capacity, said compressor comprising:

a compressor housing having a crank chamber, a suction chamber and a passageway connecting said crank and suction chambers;

a cylinder block disposed in said compressor housing;

a plurality of cylinders disposed in said cylinder block;

a plurality of pistons, each reciprocatingly disposed in a respective one of said cylinders;

a rotatable drive shaft rotatably supported in said compressor housing;

a rotor fixed on said drive shaft;

a member hinged connected to said rotor and whose angle relative to said drive shaft can be varied to vary the capacity of the compressor;

coupling means for coupling said member to said pistons to transform the rotational motion of said rotor to reciprocating motion of said pistons; and valve means for opening said passageway when pressure in said crank chamber exceeds a predetermined amount to thereby allow the excess pressure therein to vent through said passageway to said suction chamber and closing said passageway when pressure in said crank chamber falls a predetermined amount to allow the pressure to build up in said crank chamber due to blow-by gas, said valve means thereby maintaining the pressure of said crank chamber at substantially a predetermined set level while the pressure of said suction chamber is varied;

wherein said passageway is formed in said cylinder block and said valve means is disposed in said cylinder block.

14. A reciprocating piston compressor capable of operating at variable capacity, said compressor comprising:

a compressor housing having a crank chamber, a suction chamber and a passageway connecting said crank and suction chambers;

a cylinder block disposed in said cylinder housing;

a plurality of cylinders disposed in said cylinder block;

a plurality of pistons, each reciprocatingly disposed in a respective one of said cylinders;

a rotatable drive shaft rotatably supported in said compressor housing;

a rotor fixed on said drive shaft;

a member hingedly connected to said rotor and whose angle relative to said drive shaft can be varied to vary the capacity of the compressor;

coupling means for coupling said member to said pistons to transform the rotational motion of said rotor or reciprocating motion of said pistons; and varying means for varying the angle of said member based primarily on changes in said suction chamber while maintaining the pressure in said crank chamber at substantially a predetermined set level, said varying means comprising valve means for opening and closing said passageway and controlling means for controlling the operation of said valve means;

wherein said controlling means comprises pressure detecting means for detecting the pressure in said crank chamber and comparing means for comparing the detected pressure with a predetermined pressure to open said passageway when the crank chamber pressure exceeds the predetermined pressure and to close said passageway when the predetermined pressure exceeds the crank chamber pressure.

15. A compressor as set forth in claim 14 wherein said passageway comprises a cylindrical bore formed in said cylinder block, a first connecting passageway providing fluid communication between said crank chamber and said bore, and a second connecting passageway providing fluid communication between said bore and said suction chamber, and said valve means is disposed in said bore.

16. A compressor as set forth in claim 14 wherein said pressure detecting means and said comparing means comprise a bellows connected at one end to said valve means.

17. A compressor as set forth in claim 14 wherein said valve means comprises an electromagnetic valve, and said pressure detecting means comprises a pressure sensor disposed in said first connecting passageway.

18. A compressor as set forth in claim 17 wherein said comparing means comprises comparator means for electronically comparing the signal from said pressure sensor with a reference signal corresponding to the predetermined pressure.

19. A compressor as set forth in claim 17 said electromagnetic valve comprises an electromagnetic coil and a valve element, and said varying means further comprises a spring which biases said valve element to close said second connecting passageway.

20. A compressor as set forth in claim 19 wherein said controlling means comprises a control circuit comprising a comparator which compares the signal from said pressure sensor with a reference voltage, a relay controller which amplifies the signal from said comparator, and a relay which controls said electromagnetic valve in response to the amplified signal from said relay controller.

* * * * *